US005155969A

United States Patent [19]

Kuethe

[11] Patent Number: 5,155,969

[45] Date of Patent: Oct. 20, 1992

[54] HEAT SEAL VACUUM SYSTEM

[75] Inventor: David F. Kuethe, Madison, Wis.

[73] Assignee: Oscar Mayer Foods Corporation, Madison, Wis.

[21] Appl. No.: 703,274

[22] Filed: May 20, 1991

[51] Int. Cl.[5] ..... B65B 31/00

[52] U.S. Cl. ..... 53/86; 53/97; 53/329.4; 53/510

[58] Field of Search ..... 53/84, 86, 88, 89, 96, 53/97, 329.4, 374.5, 374.6, 405, 432, 433, 510, 511

[56] References Cited

U.S. PATENT DOCUMENTS

| | | | |
|---|---|---|---|
| 3,061,984 | 11/1962 | Mahaffy | 53/511 X |
| 3,298,158 | 1/1967 | Schmidt | 53/510 |
| 3,673,760 | 7/1972 | Canamero et al. | 53/433 |
| 3,832,828 | 9/1974 | Martin | 53/511 |
| 3,958,394 | 5/1976 | Mahaffy et al. | 53/511 |
| 4,009,552 | 3/1977 | Schlachter | 53/86 |
| 4,069,645 | 1/1978 | Vetter | 53/511 |
| 4,624,099 | 11/1986 | Harder | 53/510 X |
| 4,748,797 | 6/1988 | Martin | 53/432 |
| 4,777,782 | 10/1988 | Nixon, Jr. et al. | 53/511 X |

*Primary Examiner*—Robert L. Spruill
*Assistant Examiner*—Daniel B. Moon
*Attorney, Agent, or Firm*—Michael, Best & Friedrich

[57] ABSTRACT

A food product packaging apparatus for a conveyor environment, and having a vacuum chamber operatively associated with the conveyor, which vacuum chamber is selectively moved into and out of a position in sealing engagement relative to the conveyor. A manifold, a vacuum source and conduit structure are included, the conduit structure connecting the manifold structure to the vacuum source and the vacuum chamber so that the vacuum source is selectively operable to draw a vacuum in the vacuum chamber through the manifold structure. A shuttle includes frame structure and drive structure for the frame structure so that the frame structure is movable in the direction of conveyor movement and, after a predetermined increment of movement, the frame structure shuttles opposite the direction of conveyor movement to a position to repeat movement in the direction of conveyor movement for a subsequent movement for the predetermined increment. The manifold structure is connected to, and movable with, the shuttle frame structure.

8 Claims, 5 Drawing Sheets 10
12
14
16
17
30
32
34
36
38
40
42
44
46
48
50
52
54
56
58
60
61
62
63
64
65
66
67
68
69
70
71
72
74
82
116
118
120
122
124
126
130
136
A
A 82
10
140
138
12
6
120
84
86
112
88
90
33
21
17
92
94
35
14
18
20
26
102
6
19
25
23
16
128

HEAT SEAL VACUUM SYSTEM

BACKGROUND OF THE INVENTION

This invention relates to food product packaging and equipment, and, more particularly, to food product packaging which requires vacuum packing.

In many operations utilizing a machine for hermetically sealing food product trays or packages which are to be heat processed or pasteurized, the product will be sealed under vacuum.

Sealing under vacuum offers many advantages over simple hermetic sealing of a container. Sealing under vacuum causes a greatly reduced oxygen ($O^2$) concentration in the packaged food product. This has been shown to improve preservation or shelf life time significantly for most packaged food products, even for those which have not been subsequently pasteurized.

A separate advantage of vacuum sealing exists for those products that will be subsequently heat processed and sterilized, such as through a pasteurization process. Vacuum sealing reduces the total gaseous component of the container and, thus, reduces the likelihood of an excessive pressure buildup from air within the container expanding during the heat processing. Consequently, there is less likelihood of the container being separated or split at a seal by such generated internal pressures. This is particularly true for plastic or cardboard trays and packages which are sealed with plastic film, as such containers are the most fragile and would be the most susceptible to damage from internal pressures.

In one such packaging system, utilizing plastic film sealed over the containers, and utilized, for example, in the packaging of surimi products into packages, or trays, the surimi or food product is distributed to wells in plastic trays, along with a sauce or condiment component in an adjacent well. This tray is covered conventionally, with a plastic film, and is then sealed under vacuum before being conveyed to a pasteurization line. The shelf life of such vacuum packed, hermetically sealed and pasteurized products is exceedingly long, with product quality remaining high.

The conventional sealing apparatus for applying plastic film to such plastic trays utilizes heat sealing under vacuum, with subsequent pasteurization. To facilitate the overall speed of the packaging operation, the film is laid over the trays, and the heat seal is subsequently applied under vacuum, in a moving conveyor environment. The conveyor has tray supports carried on and movable with the conveyor, with a plurality of trays supported thereon. The vacuum heat seal must be applied, then, under such circumstances that the sealing means will duplicate the movement of the conveyor. The conveyor chain carries the tray supports as a series of connected units. Each such unit is conventionally a steel plate, or platter, with depressions or wells for supporting the trays, and which also support the trays when the trays are contacted by the film sealing means.

A reciprocating system is used wherein the vacuum chamber is part of a vacuum assembly on a frame which shuttles back and forth along the conveyor line. The vacuum chamber extends over the trays, and clamps down around, and encapsulates, a conveyor platter (the tray support) holding the food product tray. The vacuum assembly then reciprocates relative to the movement of the conveyor. The frame moves initially with the conveyor and continues to encapsulate the conveyor platter until the sealing can be completed.

Sealing occurs only after the desired amount of vacuum has been drawn. A heated platen comes down within the vacuum chamber and seals the plastic film to the edges of the plastic tray. By utilizing such a reciprocating system, the sealing operation is performed on trays which are continuously in motion along with the principal conveyor. Hydraulic or pneumatic systems with suitable controls are utilized to coordinate the movements of the vacuum chambers with the direction and speed of the conveyor and trays, and such systems can also control the application and timing of the vacuum and heat sealing operations. After sealing is completed, the chambers release the conveyor platter and shuttle back against the direction of movement of the conveyor to a position where they are ready to encapsulate another platter and repeat the vacuum and sealing operations.

In the known vacuum shuttle assembly, the frame includes plural vacuum chambers which are utilized simultaneously, each of the chambers having heated platens which come down inside the chamber to form the seal on multiple trays which are sealed during a single shuttle. The vacuum source is provided by a vacuum pump, which is connected by a conduit to a vacuum manifold, and through this manifold to both the upper and lower chambers. In this known packaging apparatus, the vacuum manifold is kept near the vacuum pump in a stationary matter. The manifold draws the vacuum from the plural upper and lower vacuum chambers through separate conduits, or hoses.

Difficulties arise in pulling an equal amount of vacuum through each of the hoses. As the reciprocating heat sealing apparatus moves back and forth with the conveyor, the hoses from the manifold are themselves flexed and are moved back and forth through different hose lengths, depending on which chamber a given hose leads to. When the vacuum is drawn, it is important that the vacuum in each upper and lower chamber be equivalent in order that the sealing of the plastic film to the trays will proceed in an efficient and unimpeded manner. It is difficult to maintain this level of consistency with this known arrangement.

Among the objects of this invention is to provide an improved system for heat sealing plastic film to food product trays under vacuum, and which can be used to vacuum seal continuously conveyed trays.

A more specific object is to provide such an improved system as part of an apparatus which follows the movement of the tray conveyor and does not suffer any loss in the amount of vacuum or in the strength or integrity of the subsequent seal as a consequence of the apparatus movements.

A further object is to provide such a vacuum system that will consistently pull a strong, even vacuum among the upper and lower vacuum chambers of such a reciprocating heat sealing apparatus.

SUMMARY OF THE INVENTION

For the achievement of these and other objects, this invention provides an improved packaging apparatus. The apparatus includes a vacuum sealing assembly which works in concert with a conveyor system. The conveyor system includes tray support means carried on and movable with a conveyor, a plurality of trays supported by the tray support means, and the vacuum assembly. This assembly includes a vacuum chamber operatively associated with the conveyor and extending over at least one of the trays, operating means connected to the vacuum chamber for selectively moving the vacuum chamber into a position in sealing engagement relative to the trays and selectively away from the sealing engagement position, a vacuum source, a manifold for communicating the vacuum, and conduits connecting the manifold to the vacuum source and the vacuum chamber so that the vacuum source is selectively operable to draw a vacuum in the vacuum chamber through the manifold. The vacuum assembly is mounted on a shuttle which includes a frame and drive means for the frame for selectively moving the frame in the direction of conveyor movement for a predetermined increment of movement and subsequently moving the frame opposite to the direction of conveyor movement for the same increment of movement. In this manner, the frame is movable in the direction of conveyor movement and after a predetermined increment of movement the frame shuttles opposite to the direction of conveyor movement to return to a position for repeat movement in the direction of conveyor movement, again over the predetermined distance or increment of movement. The apparatus has the manifold connected to and movable with the shuttle frame.

One embodiment of the invention provides such a packaging apparatus which includes cover means for the trays, as well as means for feeding the cover means in overlapping relationship with the trays as the trays are moving with the conveyor, and just prior to the vacuum chamber being operatively associated with the conveyor. Also included is sealing means for establishing an airtight connection of the cover means with the trays after the vacuum has been drawn in the vacuum chamber.

In another embodiment of the vacuum assembly, the cover means completely covers the tray support means such that the trays are separated by the cover means from that portion of the vacuum chamber above the conveyor means. The vacuum conduits are preferably in the form of separate conduits in communication with vacuum chamber portions above and below the conveyor means. The trays can be supported in relatively spaced apart pairs on the tray supports, and the tray support may include means defining ports through which the portion of the vacuum chamber below the conveyor communicates with the trays. These ports are preferentially positioned relative to the trays making up one of the pairs with common portions of both trays being equidistant from the ports. The tray supports include a body and spaced depressions in the body for receipt of the trays in each depression, and the ports preferably are located in the body between the spaced depressions.

Further in the preferred embodiment, the vacuum system includes ports in the manifold to which the conduit means are connected, one of the ports connecting the manifold to the conduit means connected to the vacuum source. This is a main vacuum port. Additional ports connect the manifold to the conduit means and to separate portions of the vacuum chamber. These are vacuum chamber ports. The vacuum chamber ports are spaced relative to one another about the manifold means, and each of the vacuum chamber ports are spaced equidistant from the main vacuum port. The vacuum chamber ports are preferably the same size and the conduit means are hoses attached to the vacuum chamber ports having identical lengths and diameters. This arrangement greatly facilitates equal vacuums being drawn among the various vacuum chamber portions.

Other features and advantages of the invention will become apparent to those of ordinary skill in the art upon review of the following detailed description, claims, and drawings.

Figures 2, 7A:
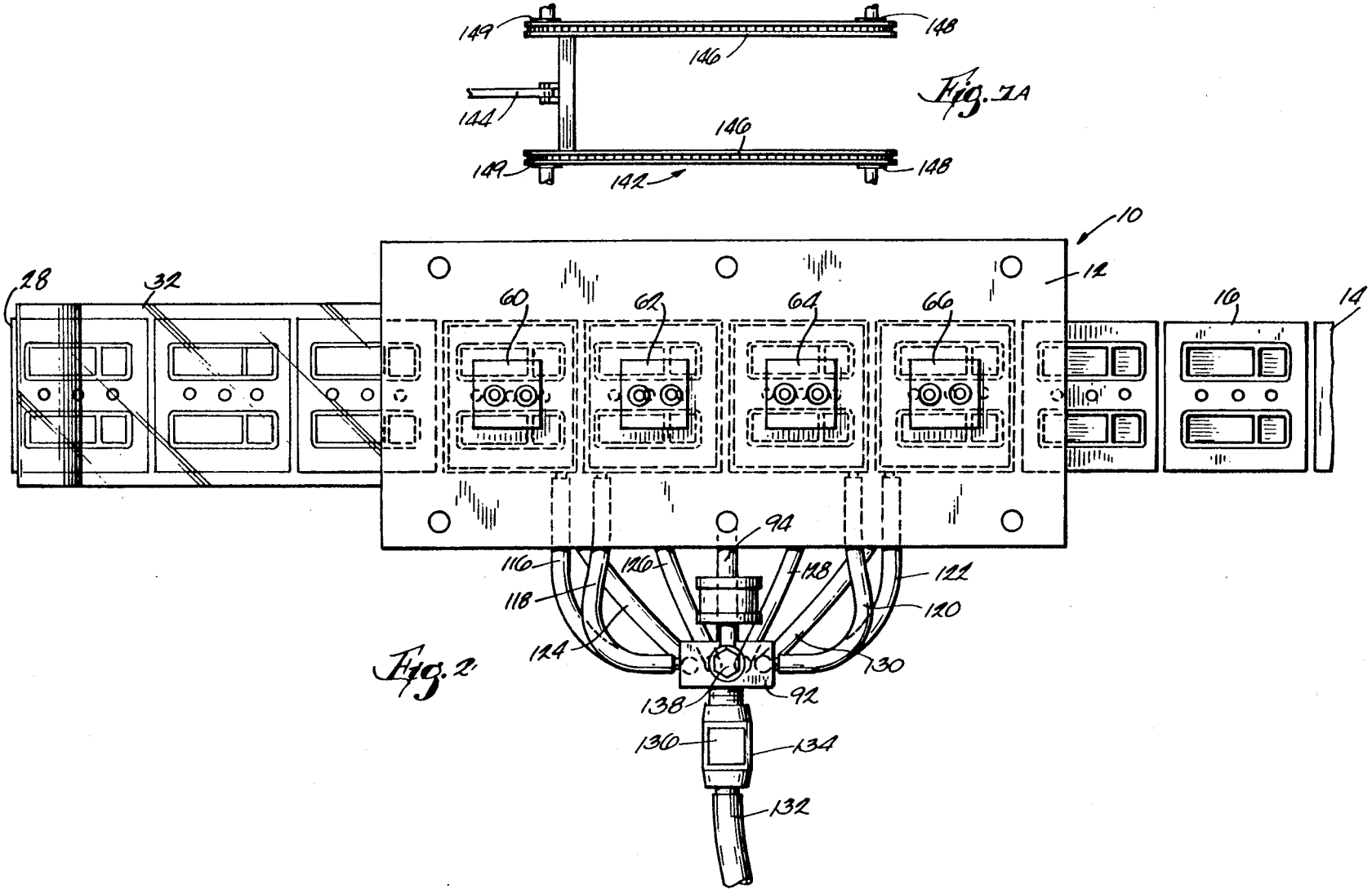
FIG. 2 is a vacuum heat seal shuttle assembly from the top.
Figure 7:
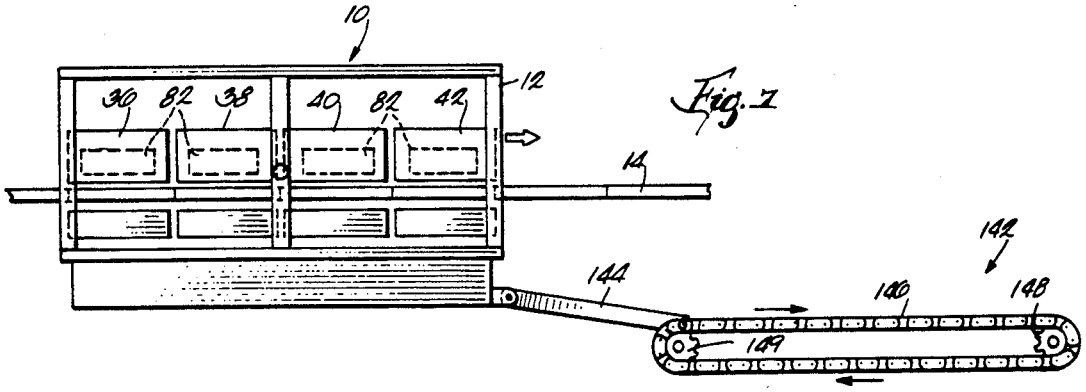
FIG. 7 is a schematic view of the entire vacuum assembly from the side, showing the mode of movement with the conveyor.

FIG. *7a* is a top view of the conveyor assembly in FIG. 7.

Figure 8:
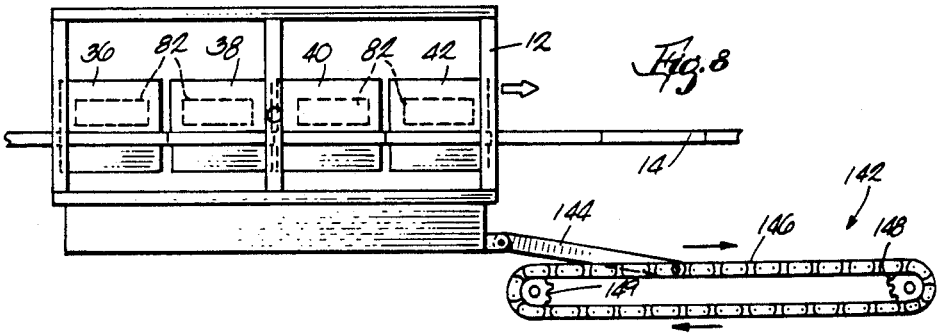

FIG. 8 is the same schematic view as in FIG. 7, showing the assembly advanced along the conveyor, and showing the vacuum chambers closed on the platters.

Figure 9:
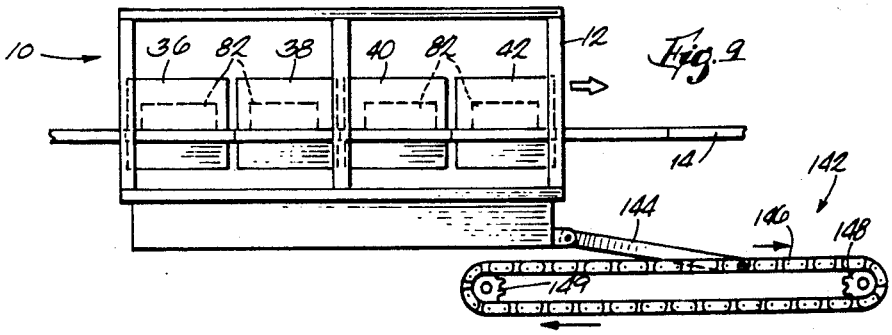

FIG. 9 is the same schematic view of the entire vacuum assembly from the side, further advanced along the conveyor, and showing the vacuum chambers closed and the heat seal units lowered for sealing the trays.

Figure 10:
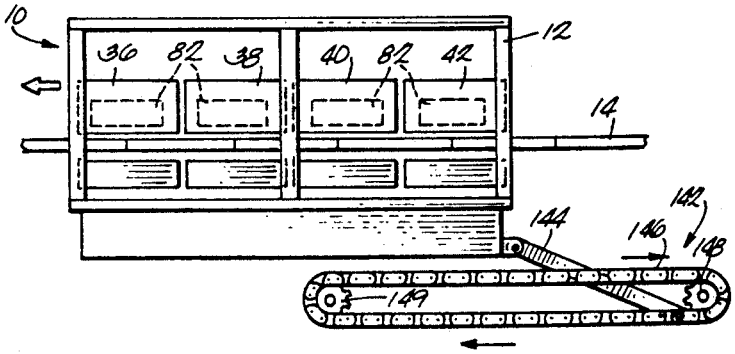

FIG. 10 is the same schematic view of the entire vacuum assembly from the side, showing the vacuum chambers opened, the heated platens raised, and the entire assembly being pushed for return against the direction of conveyor movement.

DESCRIPTION OF THE PREFERRED EMBODIMENT

Surimi products are a new and fast growing field within the food product industry, and are an example of one type of food product to which this invention relates. They generally comprise one type of marine product processed in a manner intended to duplicate the taste and form of more expensive kinds of marine products. As one example, imitation lobster or crab meat is now commonly produced from the flesh of less expensive ocean fish.

The surimi process produces elongated strips or rolls of the surimi product but, in packaging, the product is frequently sold as smaller portions or as a collection of chunks. In those cases, prior to packaging such surimi products, the larger surimi starting material is chopped into a smaller dimensioned product and packaged. The packaging process then generally comprises conveying chopped product to a packaging area, where it is sorted and allocated by weight or volume to individual containers.

In the processing machine for packaging surimi chunks, a conveyor brings containers or buckets filled with surimi to the packaging machine, the strips of surimi having previously been chopped into chunks or otherwise processed into the form in which the surimi is to be packaged and sold. The product is continuously distributed to scaling hoppers, which weigh the food product therein. Appropriate weights of product are calculated from the various scaled hoppers and released at the appropriate time in combinations forming total proper weights, and are dispensed to accumulation hoppers. These hoppers finally distribute the surimi to plastic packages or trays, which pass the scaler and filler machine on a separate conveyor, and which are ultimately conveyed to a vacuum sealing station.

Figure 3:
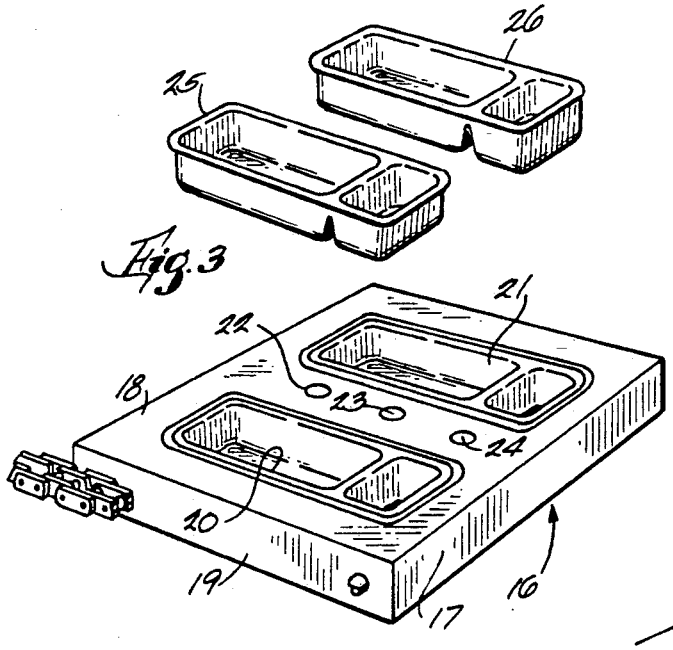
FIG. 3 is a conveyor platter showing the recessed portions for containing the trays, the vacuum ports, and the mode of attachment to the conveyor chain.
Figure 6:
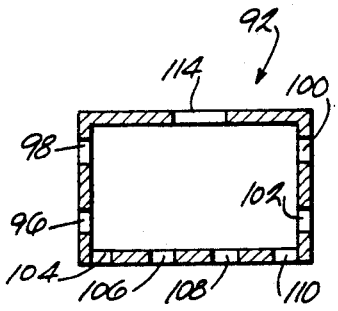
FIG. 6 is a view along line 6—6 in FIG. 4 of the manifold cut away to show ports.

The invention provides an improved vacuum and sealing apparatus or assembly 10 (FIGS. 1 and 2), which can be used with such a food product packaging arrangement. The vacuum apparatus is used in conjunction with heat sealing means, in the illustrated embodiment these functions are combined together within an assembly carried on a frame, or shuttle carriage 12. The shuttle carriage reciprocates relative to the conveyor 14, in one travel sense moving with the conveyor while the food packages are sealed under vacuum. The conveyor 14 is a series of identical units or platters 16 (FIG. 3) connected to a common drive chain (not shown), and it travels from left to right as viewed in FIG. 1. Each platter 16 has a body 17, an upper surface 18 and a lower surface 19. In the illustrated embodiment, each platter 16 also has two spaced depressions 20 and 21 and three holes, or ports, 22, 23 and 24 which pass through the body 17. The depressions 20 and 21 are for receipt of food product trays 25 and 26. The ports 22, 23 and 24 are located in the platter 16 between the spaced depressions 20 and 21. The numerals referring to platter components will be the same for each platter throughout this description.

Figure 1:
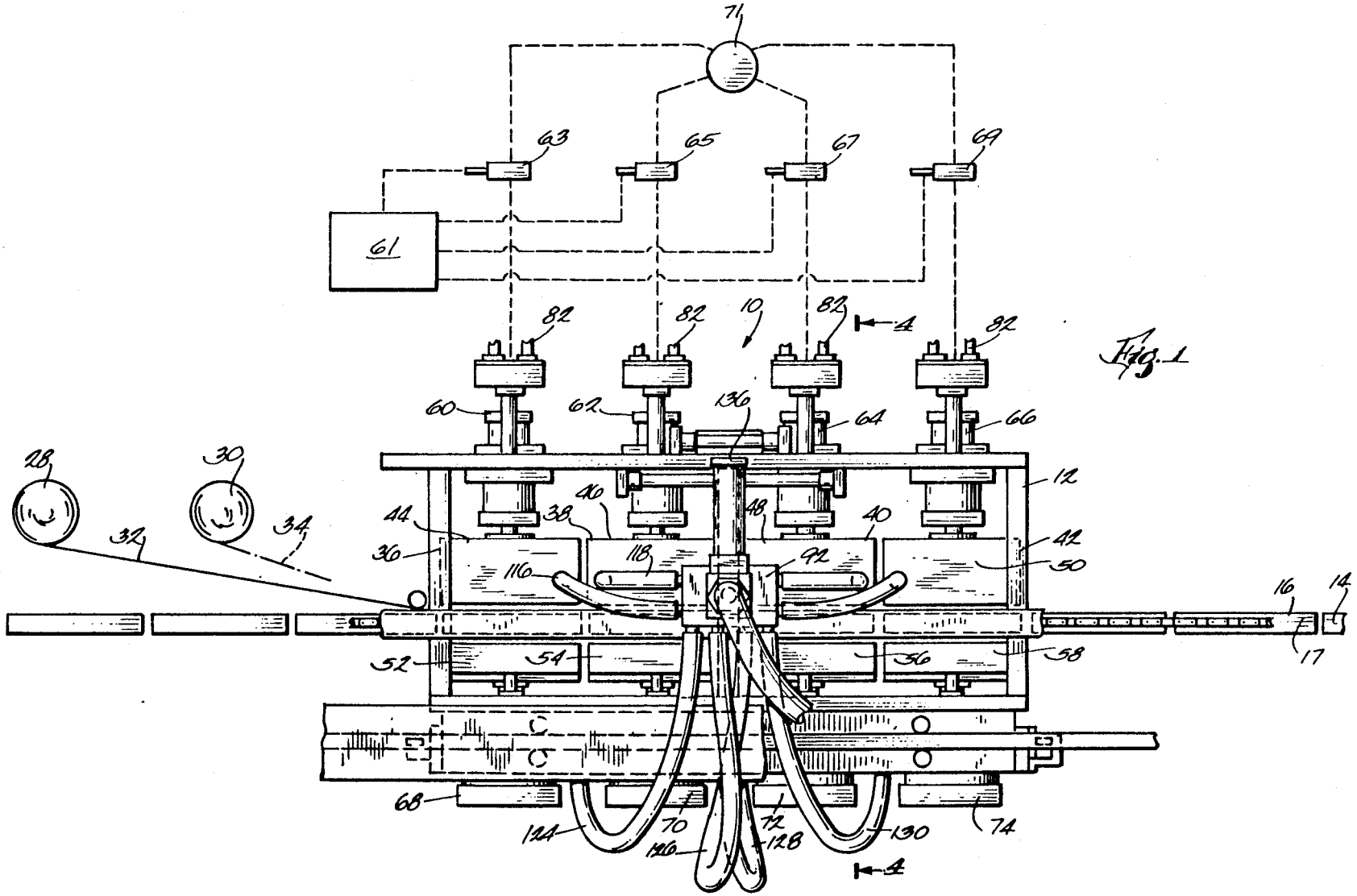
FIG. 1 is a vacuum heat seal shuttle assembly from the side, with the vacuum manifold.

Means 28 and 30 are provided for feeding film in overlapping relationship with the trays 25 and 26 as they are conveyed (FIGS. 1 and 2). Preferably, a heat deformable sealing film or sheet 32 is fed off of roll 28 and laid directly over the plastic trays 25 and 26. Roll 30 is a storage roll, and comes into operation to feed the cover film 34 after the supply in roll 28 is exhausted FIG. 1). This permits the machine to run virtually continuously.

Figure 5:
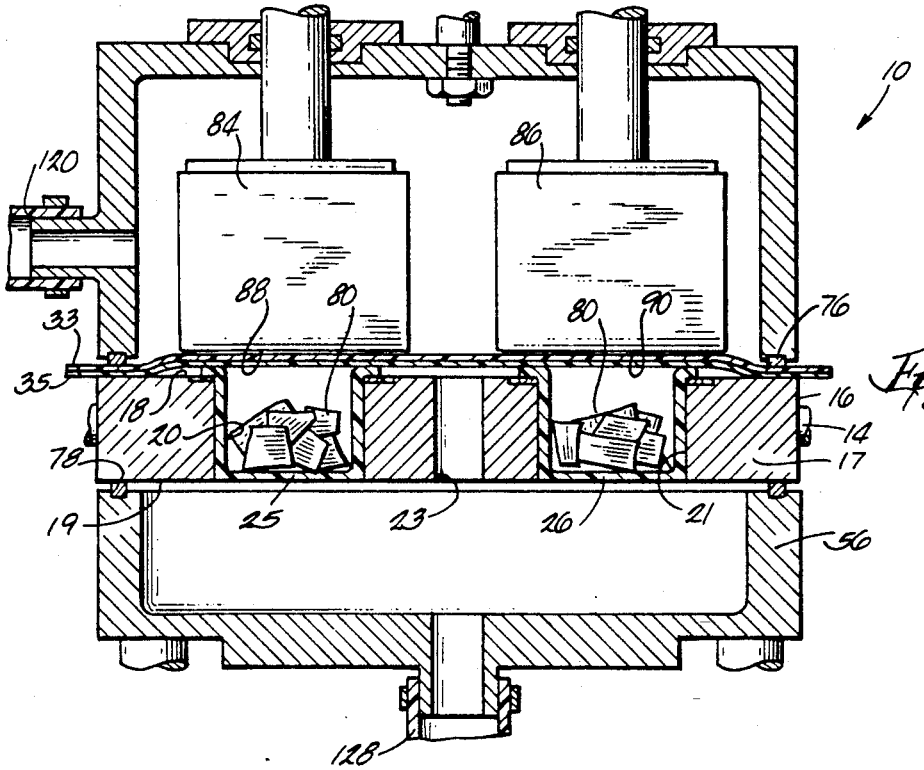
FIG. 5 is an view of a portion of the vacuum chamber depicted in FIG. 4, showing the upper and lower portions in sealing engagement, and the heat seal being applied to trays holding the product.

The film 32 is a multilayer sheet, see FIG. 5, with an upper layer 33 which is impermeable to air and a lower layer 35 which is heat deformable and capable of sealing to the tray upper surfaces as will be described more completely herewith. The sheet is preferably laid over the conveyor 14 just prior to its passage through the area of the vacuum sealing assembly 10.

The vacuum sealing assembly 10, as illustrated, has four major vacuum chambers, 36, 38, 40, and 42, each having portions above and below the conveyor 14. These portions constitute four upper vacuum chambers 44, 46, 48 and 50 and four lower vacuum chambers 52, 54, 56 and 58. Operating means 60, 62, 64, 66, 68, 70, 72 and 74 are provided for selectively moving the upper chambers 44, 46, 48 and 50 and lower chambers 52, 54, 56 and 58 toward the conveyor 14 and into a position in sealing engagement with four of the conveyor platters 16 holding the trays 25 and 26, and selectively away from the conveyor 14 and out of sealing engagement with the platters 16. The operating means 60, 62, 64, 66, 68, 70, 72 and 74 are preferably two-way air cylinders operated by a programmable controller 61 illustrated in FIG. 1. Controller 61 selectively operates solenoid valves 63, 65, 67, and 69 to control the flow of compressed air from compressed air source 71 to relative one of cylinders 60, 62, 64, and 66. An identical solenoid/programmable controller/compressed air source is provided for cylinders 68, 70, 72, and 74, but not shown as it is the same as that illustrated with 60, 62, 64, and 66.

The operation of the vacuum chambers 36, 38, 40 and 42 will be described with reference to FIGS. 4 and 5, wherein the operation of one chamber 40 will be described in detail, each of the four chamber operations being understood to be identical for the purposes of this description. The upper and lower chambers 48 and 56 close onto and encapsulate a platter 16. The upper and lower chamber edges have compressible gaskets 76 and 78 which form a uniform and tight seal with the platter surfaces 18 and 19. The upper chamber gasket 76 actually presses into the film upper layer 33, and holds the film 32 down around the platter periphery, keeping the film lower layer 35 against the trays 25 and 26. The carriage 12 shuttles the vacuum sealing assembly 10 forward in the direction of the movement of the conveyor 14. Vacuum is pulled from the upper and lower chambers 48 and 56 simultaneously, the film 32 separating the vacuum chambers 48 and 56 above and below the conveyor 14 into two distinct volumes which are not in communication with each other.

The trays 25 and 26 setting in each conveyor platter 16 are beneath the film 32, and are thus separated from the vacuum chamber 48 above the conveyor 14. The food product 80 (FIG. 5) in the trays 25 and 26 is in communication with the vacuum chamber 56 below the conveyor by the means defining holes, or ports, 22, 23 and 24, which pass through the platter body 17. This is the manner in which the lower portion 56 of the vacuum chamber below the conveyor communicates with the trays 25 and 26 to evacuate the trays. The trays 25 and 26 are supported in relatively spaced apart pairs in the platter 16, and the ports 22, 23 and 24 are positioned relative to the trays 25 and 26 making up one of such pairs with common portions of both trays 25 and 26 being equidistant from the ports 22, 23 and 24. These holes 22, 23 and 24 and their location relative to the trays, facilitate rapid, efficient and even evacuation of the trays 25 and 26 to either side. The corresponding portions of food product 80 in the trays 25 and 26 are thus in close proximity to the holes 22, 23 and 24 in each conveyor platter 16.

Means 82 is provided within the upper vacuum chamber 48 for providing an airtight connection of the film 32 with the trays 25 and 26 while the vacuum condition is present within the vacuum chamber 40. This sealing means 82 establishes an airtight connection of the film lower layer 35 to the trays 25 and 26 after the vacuum has been drawn in the vacuum chamber 40. In the preferred embodiment, the heat seal means 82 for the two trays 25 and 26 are provided separately by two heat sealers 84 and 86 which are lowered within the upper chamber 48, and which heat seals the plastic layer 35 to the trays 25 and 26. The heat sealers 84 and 86 have lower surfaces, or platens 88 and 90, which are heated to approximately 450° F. When the intermediate film 32 encounters such a temperature, lower layer 35 deforms to form the seal between the edge of the plastic trays 25 and 26 and the air impermeable outer film layer 33.

The various movements of the vacuum sealing assembly 10 are all controlled by conventional pneumatic actuators as illustrated in FIG. 1 and as previously described, which act to open and close the vacuum chambers and separately raise and lower the heat sealers within the chambers. The necessary electrical connections are also conventional, and preferably enter at the top of each vacuum-chamber as close as possible to the heat seal itself.

The evacuation of the chambers is produced by a separate vacuum pump of any conventional type (not shown). As mentioned, the vacuum sealing assembly 10 utilizes four distinct chambers 36, 38, 40 and 42. The vacuum is pulled directly from each upper chamber 44, 46, 48 and 50 and each lower chamber 52, 54, 56 and 58, so the vacuum must be communicated to each of eight chambers. The vacuum is so divided through the use of a vacuum manifold 92.

Figure 4:
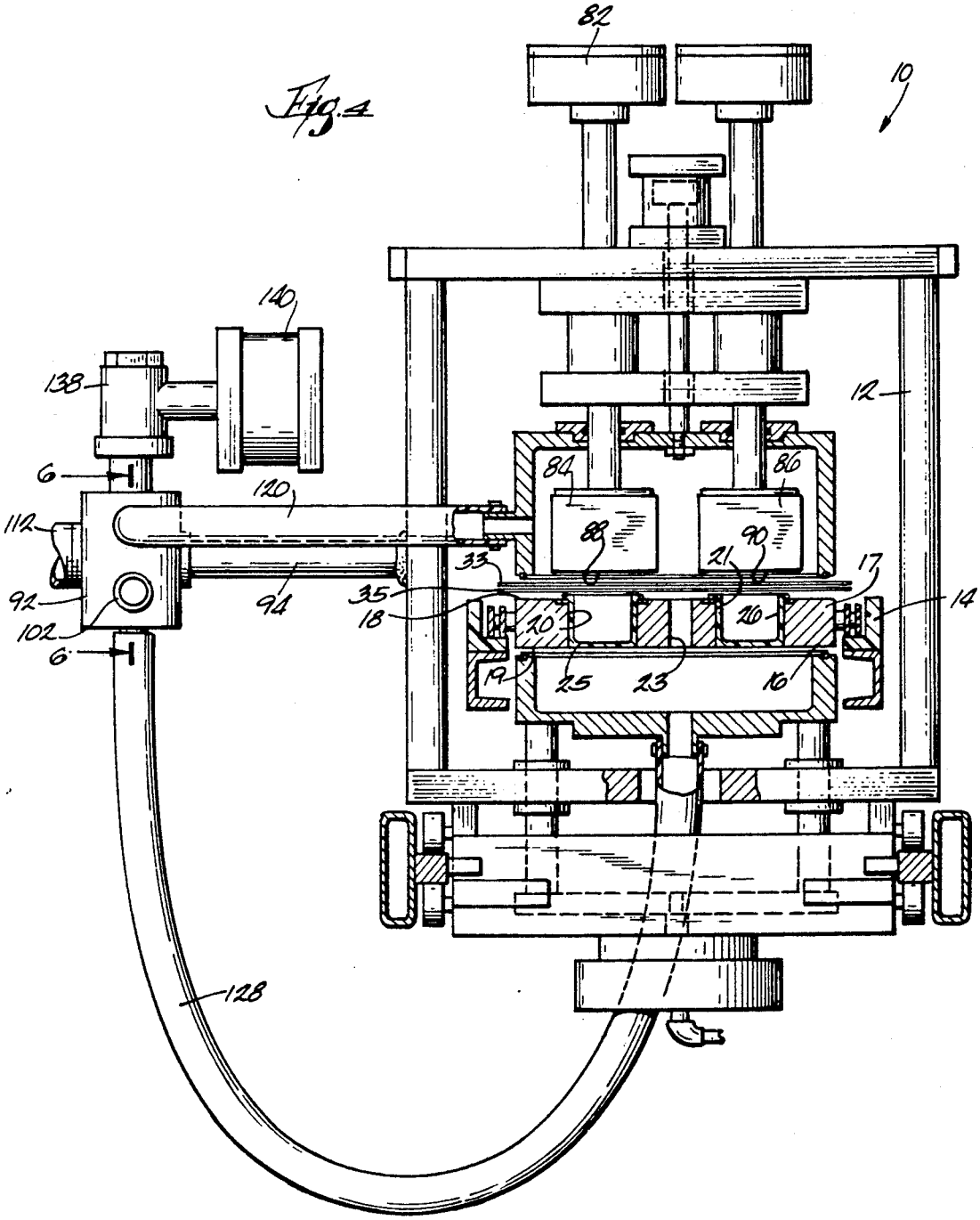
FIG. 4 is a view along line 4—4 in FIG. 1 showing the internal components of a vacuum chamber, and showing the connection to the manifold.

In the illustrated embodiment, the vacuum manifold 92 is secured to the carriage 12 of the reciprocating vacuum sealing assembly 10 through the means of a simple steel pipe 94 welded at one end to the manifold 92 and at the other to the carriage 12 (FIGS. 2 and 4). The manifold 92 thus moves with the vacuum sealing assembly 10.

In the illustrated embodiment, holes or ports 96, 98, 100, 102, 104, 106, 108, 110, 112 and 114 are in, and spaced relative to one another about, the manifold 92 (FIGS. 1, 2, 4 and 6). Conduits 116, 118, 120, 122, 124, 126, 128, 130 and 132 connect to the manifold at respective ports 96, 98, 100, 102, 104, 106, 108, 110 and 112, the conduits preferably conventional vacuum tubes or hoses. The vacuum manifold 92 is connected to the vacuum source or pump through the use of single large vacuum hose 132, which connects to a port 112 (not depicted in FIG. 6). The remaining ports 96, 98, 100, 102, 104, 106, 108 and 110 are vacuum chamber ports, and connect the manifold 92 to hoses 116, 118, 120 and 122 connected to the upper vacuum chambers and hoses 124, 126, 128 and 130 connected to the lower vacuum chambers. Each of the vacuum chamber ports 96, 98, 100, 102, 104, 106, 108 and 110 are the same size and are spaced equidistant from the main vacuum port 112. The hoses 116, 118, 120, 122, 124, 126, 128 and 130 attached to the vacuum chamber ports are preferably of substantially identical lengths and diameters. At its most basic level, then, the manifold 92 is a chamber with one large hole or port for connecting to a hose which connects to a vacuum pump, and numerous separate ports for connecting to hoses connecting to the various chambers.

The illustrated embodiment includes (FIGS. 1, 2 and 4) a ball valve assembly 134 with an attached vacuum actuator 136. The vacuum actuator 136 controls the vacuum through the ball valve assembly 134, and coordinates the drawing of the vacuum through the manifold 92 to the actual movements of the components of the assembly 10, such that the vacuum is drawn only when the top and bottom chambers have closed upon the conveyor platters. These vacuums are released by a repressor valve assembly 138 which vents the chambers through the top of the manifold 92, and which is controlled by a separate actuator 140 to occur after sealing is complete. When the vacuum is drawn through the actuator opened ball valve assembly 134, the repressor valve assembly 138 is closed. When the repressor valve assembly 138 opens, releasing the vacuum, the ball valve assembly 134 is closed off and seals the manifold 92 from the vacuum pump.

In operation, the plastic film 32 overlays the conveyor line 14, and subsequently the four vacuum chambers 36, 38, 40 and 42 close down upon four conveyor platters 16. Eight food product trays are evacuated and vacuum sealed to plastic film for every such cycle of the shuttle assembly. After the top 44, 46, 48 and 50 and bottom 52, 54, 56 and 58 chambers have closed upon the four conveyor platters 16, the entire assembly moves in the direction of the conveying line, while the vacuum and heat sealing operations are coordinated, in a conventional manner, such that after a predetermined increment of movement and/or time the vacuum chambers are opened. The trays leaving the assembly are evacuated of air and heat sealed to the plastic film. The plastic film remains in a sheet, and so it is then cut around the edges of the trays in a conventional manner (not illustrated) such as by a die. The excess sheeting is then removed, leaving only the plastic that is sealed to the individual trays.

After an operation such as this, the shuttle carriage 12 is moved back along the conveyor line until it is ready to encounter the next series of eight trays within four conveyor platters.

As depicted, generally schematically, in FIGS. 7, 8, 9 and 10, the shuttle carriage 12 is a frame upon which the vacuum and heat sealing means are assembled. Drive means 142 is provided for selectively moving the shuttle carriage 12 in the direction of conveyor 14 movement for a predetermined increment of movement, and then selectively moving the shuttle carriage 12 in a direction opposite to the direction of conveyor movement for the same predetermined movement increment. The shuttle carriage 12 thus moves in the direction of conveyor 14 movement and, after the increment of movement, the shuttle carriage 12 shuttles opposite the direction of conveyor 14 movement to a position from which it can repeat the movement in the direction of conveyor 14 movement for subsequent movement through the predetermined increment.

Control of the reciprocating movements of the shuttle vacuum assembly 10 is by conventional means, i.e., pneumatics. As currently practiced, drive means 142 includes a bar 144 connected to the shuttle carriage 12 and at its other end connects to a closed loop chain or chains 146 (FIG. 7*a*). The chain is oval and loops two sprockets, one a drive sprocket 148 and the other an idler sprocket 149. Sprocket 148 is on a drive which is connected to the principal conveyor drive, so that the speeds of the shuttle and the principal conveyor are synchronized. Chain 146 and bar 144 control the back and forth movements of the shuttle carriage 12. The operation is timed in concert with the vacuum and heat sealing operations of the assembly 10 (FIGS. 7, 8, 9 and 10). The actions of raising the heat sealers and opening the vacuum chambers are necessary prerequisites to sending the shuttle carriage back against the direction of the conveyor, and must be appropriately controlled. On the forward cycling portion of the chain loop (FIGS. 7, 8 and 9), the bar 144 pulls the shuttle in the direction of conveyor movement, to the right in the drawing. During this time, at the start of this movement in the direction of conveyor movement, the vacuum chambers close (FIG. 8), the vacuum is drawn and after the vacuum is established the heat sealing takes place (FIG. 9). Prior to the bar circling the sprocket 148 and pushing the shuttle carriage 12 back in its return movement mode against the direction of movement of the conveyor 14 (FIG. 10), the heat seal platens are raised and the vacuum is broken by opening valve 138. The vacuum chambers are then opened by being moved away from the platters.

The opening and closing of the vacuum chambers, as well as the movement of the heated platens within the vacuum chambers above the conveyor, are achieved through conventional pneumatic systems 60, 62, 64, 66, 68, 70, 72 and 74, and are timed by the use of a conventional programmable controller 61. This is in the form of a solenoid controlled two way air cylinder, as previously described. When the sealing process begins, the solenoids operate so that the bottom chambers raise and contact the bottom surfaces of the conveyor platters and simultaneously the top chambers lower and contact the plastic film overlaying the upper surfaces of the conveyor platters. During a timed sequence, a vacuum is drawn and subsequently the heat sealers lower and contact the plastic film, creating the heat seals. When the shuttle nears the end of the forward movement, the solenoids operate to, first, raise the heat sealers, next interrupt the vacuum through the repressor valve, and then raise the upper vacuum chambers and lower the lower vacuum chambers.

An override arrangement can also be provided whereby at a point in the forward movement of the shuttle carriage a safety switch (not illustrated) is tripped to raise the heat sealers, break the vacuum, and open the chambers if they have not done so already by action of working programmable controller. The shuttle carriage should not operate such that the return movement of the shuttle against the movement of the conveyor begins without the vacuum being broken and the vacuum chambers opening. This safety arrangement can override the programmable controller and automatically break the vacuum and raise the platens to open the vacuum chambers to allow the shuttle to be safely returned.

In accordance with this invention, the total volumes of the spaces drawn by vacuum hoses leading from the manifold to the upper chamber and to the lower chamber have been substantially equalized, and any variation in volume is inconsequential. The volumes in the upper and lower vacuum chambers are substantially the same. As importantly, the hoses from the manifold to the various chambers are of the same diameter and length, and thus the hose volumes are also equal. These latter volumes constitute the substantial portion of the total volume of air that must be evacuated by the vacuum through a given port of the manifold. The vacuum drawn from upper and lower chambers through these ports is, then, also identical. This translates in the pressures across the plastic sheeting overlaying the conveyor platters being substantially equal. As a consequence, an equal vacuum is pulled simultaneously from bottom and upper chambers, with the desired level of vacuum achieved prior to the heat sealing operation. By having the manifold attached to, and consequently moving with, the shuttle operation, the hoses running from the manifold to the vacuum chambers do not move back and forth with the operation of the conveying assembly, but rather remain in a relatively fixed position, only slightly raising or lowering at their ends to accommodate the closing of the chambers upon the conveyor platters, or the release of those same chambers. This additional stability contributes to the even consistent vacuum provided by the vacuum sealing assembly.

If, as in the known vacuum heat seal assembly manifold, the vacuum lines to the top chambers are different in diameter or different in length than the vacuum lines connecting the manifold to the lower chambers, then a stronger vacuum will be pulled in the top chamber. This stronger vacuum will more completely pull air from the chamber above the film, which causes the film to be pushed up against the vacuum of the upper chamber by the greater pressure in the lower chamber. When so pushed up into or against the upper vacuum chamber the efficiency of the vacuum pulled there is downgraded, the vacuum fighting the strength of the film. If the vacuum in the lower chamber is too great, however, the film will be pushed down and will collapse about the trays before evacuation of the air in the trays can be satisfactorily completed. As the sheet of plastic film completely covers the conveyor platter, it is only the bottom vacuum which actually works to evacuate the food product portion within the tray. The top vacuum thus partially functions to keep the film from being pushed down such as would effectively seal the tray prior to its complete evacuation. The film should ideally float freely over the food product trays, without being pushed too strongly in either direction. The described vacuum sealing assembly accomplishes this.

In this way, the assembly also facilitates better sealing. If the film is pulled too strongly up or down within the chamber, this will crease or wrinkle the film, and these creases or wrinkles will be subsequently pressed into the seal. These become small ridges or folds in the seal, and such ridges or folds can lead to small holes or gaps which permit contact between the food product and the ambient air. A taut and unwrinkled film results in a smooth seal, and a smooth seal greatly decreases the chances of seal failure. Another problem which can be encountered if the film is pulled up against the heat seal heads, i.e. contacts the heads prematurely due to unequal vacuum, is that it can burn or melt due to overexposure to the temperatures of the heat seal heads.

Due to the disclosed vacuum assembly a stronger vacuum can be used, which means that a sufficient vacuum for heat sealing can be achieved more rapidly, and as a consequence the heat sealing operation can be completed in a shorter amount of time. This has allowed the entire conveyor system to be run more quickly, with the result of a more rapid production pace. In the disclosed vacuum apparatus, the actions of the heat sealer and the vacuum shuttle assembly efficiently and cooperatively work to provide safe hermetic seals between the trays and the plastic sealing films even at this higher rate of operation.

Although one embodiment of the present invention has been illustrated and described, it will be apparent to those skilled in the art that various changes and modifications may be made therein without departing from the spirit of the invention or from the scope of the appended claims.

What is claimed is:

1. Packaging apparatus comprising, in combination, a conveyor, tray support means carried on and movable with said conveyor, a plurality of trays supported by said tray support means, cover means for said trays, means for feeding said cover means in overlapping relationship with said trays as said trays are moving with said conveyor, means defining a vacuum chamber having portions above and below said conveyor and extending over a preselected number of said trays, operating means connected to said vacuum chamber for selectively moving said portions of said vacuum chamber toward said conveyor and into a position in sealing engagement with said trays and selectively away from said conveyor and out of sealing engagement with said trays, a vacuum source, manifold means, conduit means connecting said manifold means to said vacuum source and said portions of said vacuum chamber, both above and below said conveyor, so that said vacuum source is selectively operable to draw a vacuum in said vacuum chamber through said manifold means from above and below said trays, means defining a shuttle including frame means and drive means for said frame means for selectively moving said frame means in the direction of conveyor movement for a predetermined increment of movement and selectively moving said frame means opposite to said direction of conveyor movement for said predetermined movement increment so that said frame means is movable in the direction of conveyor movement and after said predetermined increment of movement said frame means shuttles opposite the direction of conveyor movement to a position to repeat movement in the direction of conveyor movement for a subsequent movement for said predetermined increment, said vacuum chamber connected to and movable with said shuttle frame means, said manifold means connected to and movable with said shuttle frame means through said same increment of movement, and means in said vacuum chamber for providing an airtight connection of said cover means with said trays when a vacuum has been drawn in said vacuum chamber.

2. The apparatus of claim 1 wherein said cover means completely covers said tray support means, separating said trays from said vacuum chamber portion above said conveyor means.

3. The apparatus of claim 2 wherein said trays are supported in relatively spaced apart pairs, including means defining ports in said tray support means through which said portion of said vacuum chamber below said conveyor communicates with said trays, and wherein said ports are positioned relative to the trays making up one of said pairs with common portions of both trays being equidistant from said ports.

4. The apparatus of claim 3 wherein said tray support means includes a body and spaced depressions in said body for receipt of a tray in each depression, and said ports are located in said body between said spaced depressions.

5. The apparatus of claim 1 including means defining a plurality of ports in said manifold means, said conduit means connecting to said manifold means at said ports, one of said port means constituting a main vacuum port and connecting said manifold means to said conduit means connected to said vacuum source, the remaining ones of said port means constituting vacuum chamber ports and connecting said manifold means to said conduit means connected to said portions of said vacuum chamber, said vacuum chamber ports being spaced relative to one another about said manifold means, and wherein each of said vacuum chamber ports are spaced equidistant from said main vacuum port.

6. The apparatus of claim 5 wherein said vacuum chamber ports are the same size, said conduit means are hoses, and said hoses attached to said vacuum chamber ports have identical lengths and diameters.

7. Packaging apparatus comprising, in combination, a conveyor, tray support means carried on and movable with said conveyor, a plurality of trays supported by said tray support means, cover means for said trays, means for feeding said cover means in overlapping relationship with said trays as said trays are moving with said conveyor, means defining a vacuum chamber operatively associated with said conveyor and extending over at least one of said trays, operating means connected to said vacuum chamber for selectively moving said vacuum chamber into a position in sealing engagement relative to said trays and selectively away from said sealing engagement position, a vacuum source, manifold means, conduit means connecting said manifold means to said vacuum source and said vacuum chamber, so that said vacuum source is selectively operable to draw a vacuum in said vacuum chamber through said manifold means, means defining a shuttle including frame means and drive means for said frame means for selectively moving said frame means in the direction of conveyor movement for a predetermined increment of movement and selectively moving said frame means opposite to said direction of conveyor movement for said predetermined movement increment so that said frame means is movable in the direction of conveyor movement and after said predetermined increment of movement said frame means shuttles opposite the direction of conveyor movement to a position to repeat movement in the direction of conveyor movement for a subsequent movement for said predetermined increment, said vacuum chamber connected to and movable with said shuttle frame means, said manifold means connected to and movable with said shuttle frame means through said same increment of movement, and sealing means for establishing an airtight connection of said cover means with said trays after said vacuum has been drawn in said vacuum chamber.

8. Packaging apparatus comprising, in combination, a conveyor, tray support means carried on and movable with said conveyor, a plurality of trays supported by said tray support means, means defining a vacuum chamber operatively associated with said conveyor and extending over at least one of said trays, operating means connected to said vacuum chamber for selectively moving said vacuum chamber into a position in sealing engagement relative to said trays and selectively away from said sealing engagement position, a vacuum source, manifold means, conduit means connecting said manifold means to said vacuum source and said vacuum chamber so that said vacuum source is selectively operable to drawn a vacuum in said vacuum chamber through said manifold means, means defining a shuttle including frame means and drive means for said frame means for selectively moving said frame means in the direction of conveyor movement for a predetermined increment of movement and selectively moving said frame means opposite to said direction of conveyor movement for said predetermined movement increment so that said frame means is movable in the direction of conveyor movement and after said predetermined increment of movement said frame means shuttles opposite the direction of conveyor movement to a position to repeat movement in the direction of conveyor movement for a subsequent movement for said predetermined increment, said vacuum chamber connected to and movable with said shuttle frame means, and said manifold means connected to and movable with said shuttle frame means through said same increment of movement.

* * * * *